United States Patent [19]

Hohman et al.

[11] 4,392,310

[45] Jul. 12, 1983

[54] DRYING APPARATUS

[75] Inventors: Charles M. Hohman, Granville; Mark A. Propster, Gahanna; Stephen Seng, Bladensburg, all of Ohio

[73] Assignee: Owens-Corning Fiberglas Corporation, Toledo, Ohio

[21] Appl. No.: 274,968

[22] Filed: Jun. 18, 1981

[51] Int. Cl.[3] ..... F26B 17/32

[52] U.S. Cl. ..... 34/172; 34/173; 34/187; 198/603; 198/703

[58] Field of Search ..... 34/172, 173, 181, 187, 34/225, 233; 198/603, 608, 706, 703

[56] References Cited

U.S. PATENT DOCUMENTS 2,000,817 5/1935 Bixby ..... 34/172

3,009,689 11/1961 Hinz ..... 34/173

FOREIGN PATENT DOCUMENTS 448575 8/1927 Fed. Rep. of Germany ..... 34/172

*Primary Examiner*—Larry I. Schwartz

*Attorney, Agent, or Firm*—Ronald C. Hudgens; Philip R. Cloutier; T. F. McGann

[57] ABSTRACT

A particulate dryer is disclosed in which upwardly moving hot gases contact downwardly moving particulate matter. The particulate matter is supported by rotating trays which, due to the absence of support at their outer ends at selected loci are caused to tilt downward to effect passage of the particulate matter downwardly through the dryer.

9 Claims, 8 Drawing Figures

DRYING APPARATUS

TECHNICAL FIELD

This invention pertains to dryers. In one of its more specific aspects, this invention pertains to dryers of the rotating tray type which are particularly suitable for drying particulate matter.

BACKGROUND OF THE INVENTION

The use of particulate matter and apparatus for its drying are well known. One of the principal uses of such apparatus is for the purpose of removing the moisture entrained with particles which have been comminuted. Another use of such apparatus is for the drying of pellets which have been formed in the presence of a fluid, frequently water. Generally, such material employs a countercurrent flow between the particles to be dried and hot gases. The apparatus of the present invention employs such a drying technique.

STATEMENT OF THE INVENTION

According to the present invention, there is provided drying apparatus comprising a chamber, at least one porous sectionalized tray adapted to rotate within the chamber, the sections of the tray being supported along a leading edge, at their inward end and at their outward end, a support for the outward end of the tray, the support being discontinuous along its length, the sections being adapted to pivot downwardly when rotated over the discontinuous section of the support to discharge the particulate matter therefrom, and means for rotating the tray.

Also according to this invention, there is provided a method for drying particulate matter which comprises passing hot gases upwardly into a vessel, introducing particulate matter downwardly onto a horizontally rotating sectionalized tray within the vessel and into contact with the hot gases, tilting a section of the rotating tray to discharge the particulate downwardly from the tray, and passing the particulate matter and the hot gases from the vessel.

DESCRIPTION OF THE DRAWINGS

This invention will be more easily understood if explained in conjunction with the drawings in which:

Referring now to FIG. 1, there is shown dryer 1 which can be positioned on vessel 2 or which can be operated independently thereof. If positioned on vessel 2, the latter will usually contain a bed of pre-dried particles descended from vessel 1, which particles are moving as a bed downwardly in contact with an upwardly moving mass of hot gases which provide the heat for drying the particles.

Figure 1:
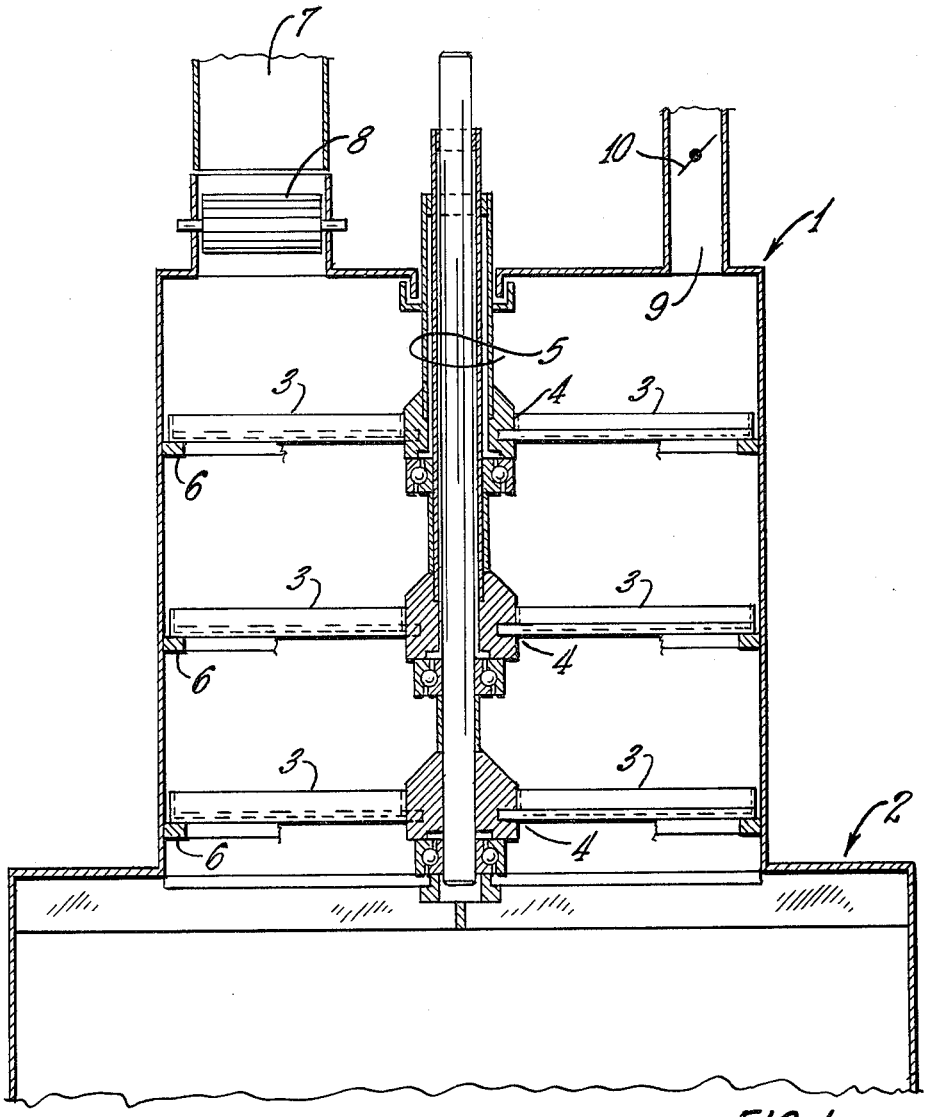
FIG. 1 is a view in vertical section of the drying portion of a pellet-preheater.

Contained within drying chamber 1 are any number of trays 3 affixed at their inner portion 4 to suitable drive shaft arrangement 5 which enables the revolving of the trays within the vessel in a horizontal plane. The trays can be driven through the shaft arrangement to revolve in the same or in opposite directions.

The trays extend outwardly from the drive shaft arrangement towards the inner wall of the chamber where they are supported by support ring 6 positioned circumferentially to the tray and to the dryer.

The chamber is adapted with pellet inlet 7 which is fitted with a rotary vane 8 to minimize vapor escape through inlet 7, and with vapor outlet 9 which can be fitted with damper 10 to control the outlet of the gases passing upwards through the trays and from the chamber through vapor outlet 9.

Figure 2:
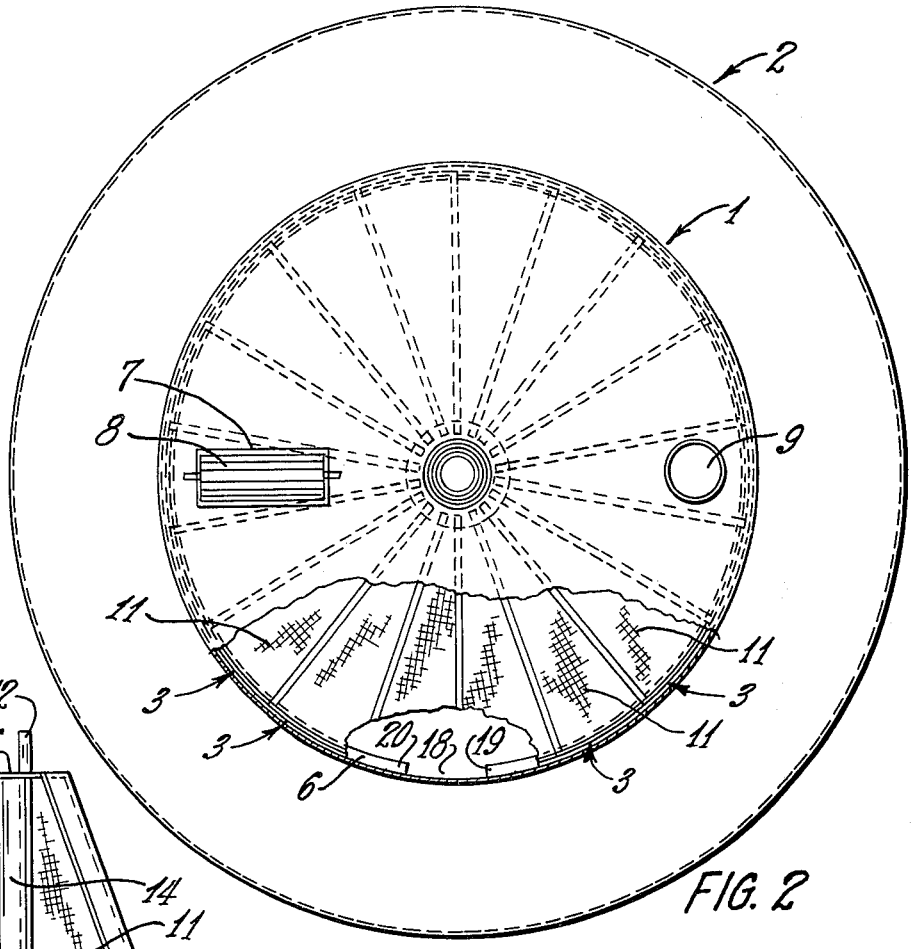
FIG. 2 is a plan view of FIG. 1, partially in section.

Referring now to FIG. 2, each tray 3 has, as its bottom surface, apertured support 11. This support can be comprised of screening, punched metal, or the like, in which the apertures are small enough to retain the material to be dried thereon, but large enough to permit the upward passage of gas therethrough without undue pressure drop.

Figure 3:
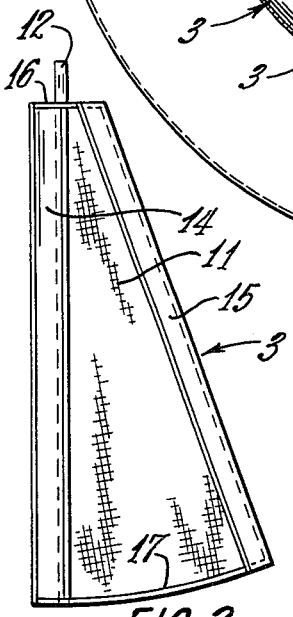
FIG. 3 is a plan view of one section of a sectionalized tray of the dryer.
Figure 4:
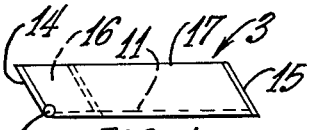
FIG. 4 is an end view of FIG. 3.

As shown in FIGS. 3 and 4, each tray comprises an inner end 16, and outer end 17, a leading wall 14 and a trailing wall 15. Each tray is also supported along its leading wall 14 by rod 12 around which each tray is adapted to pivot to that position shown in FIG. 5 in which the trailing edge has dropped to a position beneath ring 6 in such a manner as to discharge the tray's contents downwardly.

Figure 5:
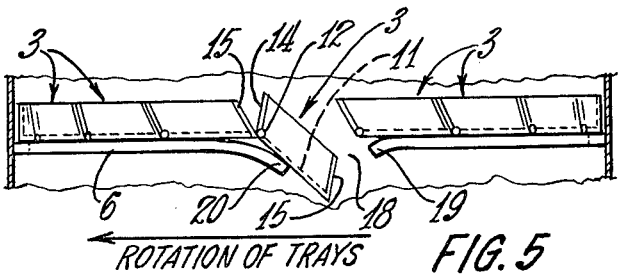
FIG. 5 is a detailed elevation view of the trays of FIG. 1.

As shown in FIGS. 2 and 5, support ring 6 acts as the support for the outer end of the trays, being affixed at or to the inner wall of the chamber. However, ring 6 is discontinuous at one or more loci 18 around the circumference of the vessel. At this discontinuity, the ring has a downwardly turning section 19 and upwardly turning section 20 when viewed relative to the direction of rotation of the tray. The distance between the downward turning section and the upward turning section is sufficient to allow the tray to pivot around rod 12 downwardly from the horizontal through the discontinuity to an extent sufficient to discharge the tray's contents.

As mentioned, ring 6 is discontinuous at one or more loci around its circumference. In the employment of a plurality of trays, it is preferable that these loci of discontinuity do not lie in the same vertical plane around the circumference of the vessel but that they be spaced at least 180° apart, and up to about 345° apart to afford the maximum time of contact between the ascending hot gases and the descending particulate matter.

Various alternate arrangements of the apparatus of this invention can be made. A second embodiment is shown in FIGS. 6, 7, and 8.

Figure 6:
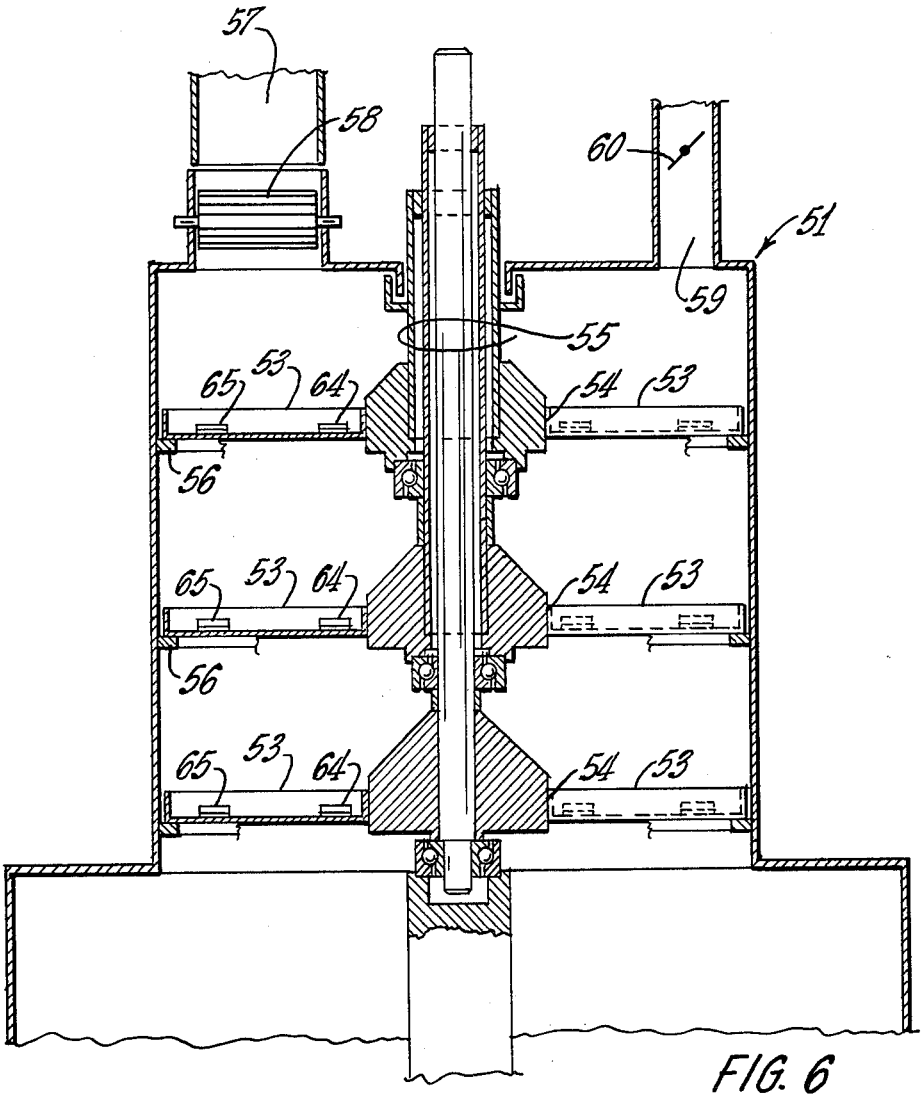
FIG. 6 is a view in vertical section of the drying portion of an alternate embodiment of the pellet-preheater.

Referring now to FIG. 6, there is shown drying chamber 51 containing any number of trays 53 affixed at their inner portion 54 to suitable drive shaft arrangement 55 which enables the revolving of the trays within the vessel in a horizontal plane in the same, or opposite directions. As in the previous embodiment, the trays extend outwardly from the drive shaft arrangement towards the inner wall of the chamber where they are supported by support ring 56 positioned circumferentially to the tray. Again, the chamber is adapted with pellet inlet 57, rotary vane 58, vapor outlet 59 and damper 60.

Figure 7:
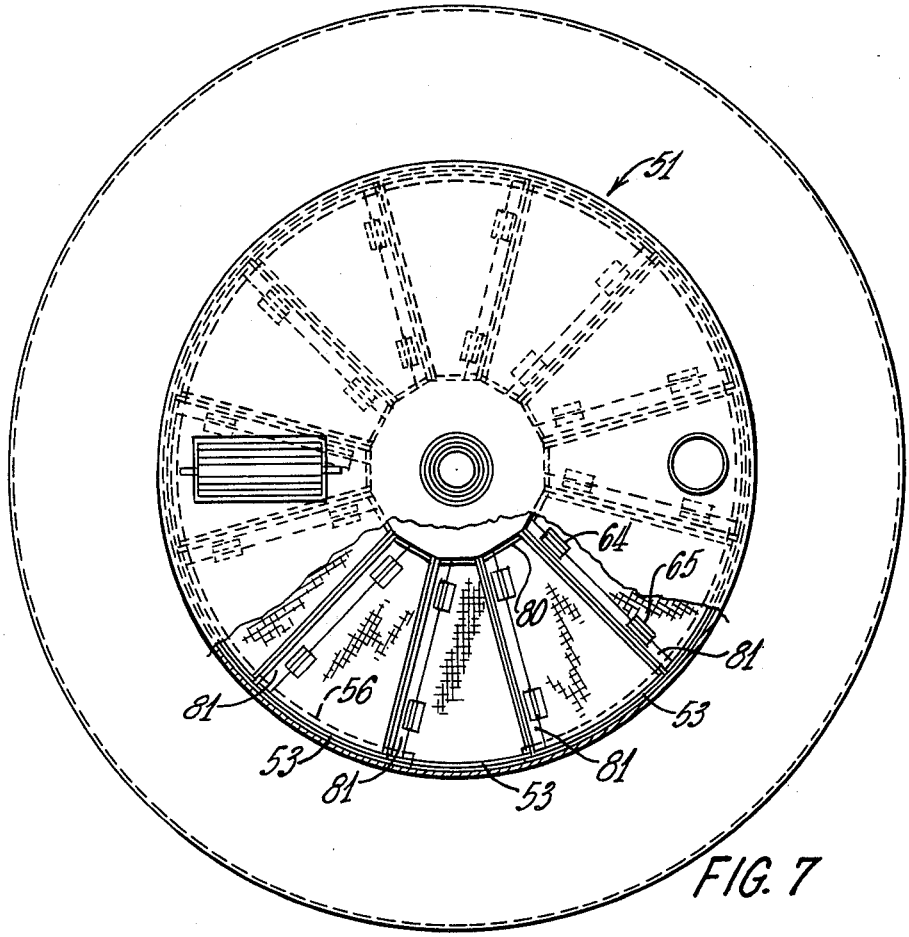
FIG. 7 is a plan view of FIG. 6.
Figure 8:
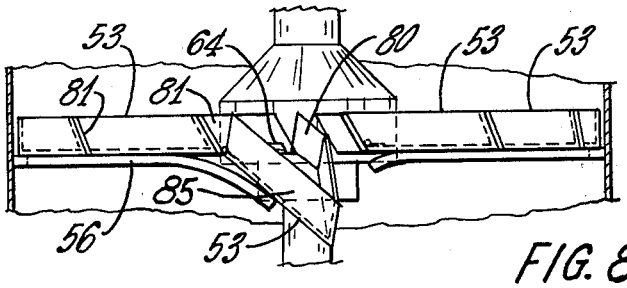
FIG. 8 is a detailed elevation view of the trays of FIG. 6.

As seen in FIG. 7, whereas the previous embodiment was adapted with what may be considered as a continuous hinge along its leading edge, the present embodiment employs a plurality of hinges 64 and 65 and an inner wall 80 which is separable from leading wall 81. Outer wall 85, as shown in FIG. 8, also separates from leading wall 81 such that, upon rotation of the tray and each section into the locus of discontinuity of support member 56, each section, individually, exclusive of its leading wall, is caused to canterlever downward into a discharging position. Previous statements as to the positioning of the discontinuous loci of support member 56 are also applicable to this embodiment.

From the foregoing, the operation of the apparatus of this invention is clear. Hot or drying gases flow upward into contact with the particulate matter positioned on the trays and from the vessel.

With the trays revolving in the same or, alternately, in different directions, the particulate matter is introduced unto the top tray. The tray revolves a selected number of degrees until it reaches a locus at which its outer support is discontinuous. The tray tilts downwardly to discharge its contents to the tray below. The leading edge of the tray encounters the upwardly turned outer support and the tray, continuing, is brought into a substantially horizontal position, in which position it continues to rotate and is refilled to continue the cycle. With the subsequent filling and sequential emptying of the trays, the particulate matter to be dried progresses downwardly through the dryer countercurrent to the flow of the gases upwardly through the dryer.

It will be evident from the foregoing that various modifications can be made to the method and apparatus of this invention. Such, however, are considered to be within the scope of the invention.

We claim:

1. A particulate dryer comprising:

(a) a vessel having a gas inlet and outlet and a particulate inlet and outlet;

(b) at least one porous tray positioned within said vessel and adapted for horizontal rotation within said vessel, said tray comprising a plurality of sections, each of said sections comprising upstanding walls comprising a leading wall, a trailing wall, an inner wall and an outer wall, said inner wall, said outer wall, and said trailing wall each being separate from said leading wall and each fixedly attached to a porous bottom surface, and a hinged support affixed to the leading edge of said section, said section leading edge comprising the bottom part of said lead wall and the leading part of said porous bottom surface;

(c) an inward rotatable support and an outer discontinuous support of said sections; and, (d) means for rotating said tray within said vessel to sequentially superimpose said sections above the discontinuous portion of said outer support and to pivot said sections, exclusive of said leading wall, downwardly at said discontinuous portion to discharge particulate matter from said section.

2. The apparatus of claim 1 in which said hinged support comprises a plurality of individual hinges.

3. The apparatus of claim 1 comprising a plurality of porous trays in superimposed positions.

4. The apparatus of claim 3 in which said trays revolve in the same direction.

5. The apparatus of claim 3 in which said trays revolve in opposite directions.

6. The apparatus of claim 1 in which said outer discontinuous support is discontinuous at a plurality of loci.

7. The apparatus of claim 6 comprising a plurality of porous trays in superimposed positions.

8. The apparatus of claim 7 in which said loci lie in different vertical planes.

9. The apparatus of claim 8 in which said loci are spaced up to about 345° apart around the circumference of said vessel.

* * * * *